US007979280B2

(12) United States Patent
Wouters et al.

(10) Patent No.: US 7,979,280 B2
(45) Date of Patent: Jul. 12, 2011

(54) TEXT TO SPEECH SYNTHESIS

(75) Inventors: Johan Wouters, Zürich (CH); Christof Traber, Zürich (CH); Marcel Riedi, Zollikon (CH); Martin Reber, Zürich (CH); Jürgen Keller, Güttingen (CH)

(73) Assignee: Svox AG, Zurich (CH)

( * ) Notice: Subject to any disclaimer, the term of this patent is extended or adjusted under 35 U.S.C. 154(b) by 831 days.

(21) Appl. No.: 11/709,056

(22) Filed: Feb. 22, 2007

(65) Prior Publication Data

US 2009/0076819 A1 Mar. 19, 2009

(30) Foreign Application Priority Data

Mar. 17, 2006 (EP) ..... 06111290

(51) Int. Cl.
*G10L 13/06* (2006.01)

(52) U.S. Cl. ..... 704/268; 704/260

(58) Field of Classification Search ..... 704/258–269
See application file for complete search history.

(56) References Cited

U.S. PATENT DOCUMENTS

| | | | | |
|---|---|---|---|---|
| 5,715,367 | A * | 2/1998 | Gillick et al. | 704/254 |
| 5,913,193 | A | 6/1999 | Huang et al. | |
| 6,665,641 | B1 | 12/2003 | Coorman et al. | |
| 7,031,924 | B2 * | 4/2006 | Kimura et al. | 704/274 |
| 7,065,489 | B2 * | 6/2006 | Hisaminato et al. | 704/268 |
| 2002/0013707 | A1 | 1/2002 | Shaw et al. | |
| 2003/0055641 | A1 * | 3/2003 | Yi et al. | 704/238 |
| 2003/0088416 | A1 | 5/2003 | Griniasty | |
| 2003/0229494 | A1 | 12/2003 | Rutten et al. | |
| 2005/0182629 | A1 * | 8/2005 | Coorman et al. | 704/266 |

FOREIGN PATENT DOCUMENTS

| | | |
|---|---|---|
| WO | WO 02/097794 | 12/2002 |
| WO | WO 2004/070701 | 8/2004 |

OTHER PUBLICATIONS

Breen A.P. and Jackson P., "A phonologically motivated method of selecting non-uniform units," ICSLP-98, pp. 2735-2738, 1998.
Sagisaka Y., "Speech synthesis by rule using an optimal selection of non-uniform synthesis units," ICASSP-88 New York vol. 1 pp. 679-682, IEEE, Apr. 1988.
Hunt A.J. and Black A.W., "Unit selection in a concatenative speech synthesis system using a large speech database," ICASSP-96, pp. 373-376, 1996.

* cited by examiner

*Primary Examiner* — Abul Azad
(74) *Attorney, Agent, or Firm* — Harness, Dickey & Pierce, P.L.C.

(57) ABSTRACT

An input linguistic description is converted into a speech waveform by deriving at least one target unit sequence corresponding to the linguistic description, selecting from a waveform unit database for the target unit sequences a plurality of alternative unit sequences approximating the target unit sequences, concatenating the alternative unit sequences to alternative speech waveforms and presenting the alternative speech waveforms to an operating person and enabling the choice of one of the presented alternative speech waveforms. There are no iterative cycles of manual modification and automatic selection, which enables a fast way of working. The operator does not need knowledge of units, targets, and costs, but chooses from a set of given alternatives. The fine-tuning of TTS prompts therefore becomes accessible to non-experts.

18 Claims, 5 Drawing Sheets

TEXT TO SPEECH SYNTHESIS

PRIORITY STATEMENT

The present application hereby claims priority under 35 U.S.C. §119 on European patent application number EP 06 111 290.0 filed Mar. 17, 2006, the entire contents of which is hereby incorporated herein by reference.

TECHNICAL FIELD

Embodiments of the present invention generally relate to Text-to-Speech (TTS) technology for creating spoken messages starting from an input text.

BACKGROUND ART

The general framework of modern commercial TTS systems is shown in FIG. 1.

An input text—for example "Hello World"—is transformed into a linguistic description using linguistic resources in the form of lexica, rules and n-grams. The text normalisation step converts special characters, numbers, abbreviations, etc. into full words. For example, the text "123" is converted into "hundred and twenty three", or "one two three", depending on the application. Next, linguistic analysis is performed to convert the orthographic form of the words into a phoneme sequence. For example, "hello" is converted to "h@-loU", using the Sampa phonetic alphabet. Further linguistic rules enable the TTS program to assign intonation markers and rhythmic structure to the sequence of words or phonemes in a sentence. The end product of the linguistic analysis is a linguistic description of the text to be spoken. The linguistic description is the input to the speech generation module of a TTS system.

The speech generation module of most commercial TTS systems relies on a database of recorded speech. The speech recordings in the database are organised as a sequence of waveform units. The waveform units can correspond to half phonemes, phonemes, diphones, triphones, or speech fragments of variable length [e.g. Breen A. P. and Jackson P., "A phonologically motivated method of selecting non-uniform units," ICSLP-98, pp. 2735-2738, 1998]. The units are annotated with properties that refer to the linguistic description of the recorded sentences in the database. For example, when the waveform units correspond to phonemes, the unit properties can be: the phoneme identity, the identity of the preceding and following phonemes, the position of the unit with respect to the syllable it occurs in, similarly the position of the unit with respect to the word, phrase, and sentence it occurs in, intonation markers associated with the unit, and others.

Unit properties that do not directly refer to phoneme identities are often called prosodic properties, or simply prosody. Prosodic properties characterise why units with the same phoneme identity may sound different. Lexical stress, for example, is a prosodic property that might explain why a certain unit sounds louder than another unit representing the same phoneme. High level prosodic properties refer to linguistic descriptions such as intonation markers and phrase structure. Low level prosodic properties refer to acoustic parameters such as duration, energy, and the fundamental frequency F0 of the speaker's voice. Speakers modulate their fundamental frequency, for example to accentuate a certain word (i.e. pitch accent). Pitch is the psycho-acoustic correlate of F0 and is often used interchangeably for F0 in the TTS literature.

The waveform corresponding to a unit can also be considered as a unit property. In some TTS systems, a low-dimensional spectral representation is derived from the speech waveform, for example in the form of Mel Frequency Cepstral Coefficients (MFCC). The spectral features contain information both about the phonetic and prosodic properties of a unit.

As was mentioned above, TTS programs use linguistic rules to convert an input text into a linguistic description. The linguistic description contains phoneme symbols as well as high level prosodic symbols such as intonation markers and phrase structure boundaries. This linguistic description must be further rewritten in terms of the units used by the speech database. For example, if the linguistic description is a sequence of phonemes and boundary symbols and the database units are phonemes, the boundary symbols need be converted into properties of the phoneme-sized units. In FIG. 1 the linguistic description of the text is "h@-loU|w3rld #" and the target unit sequence is $\{h, @^{(bnd:-)}, l, oU^{(bnd:|)}, w, 3, r, l, d^{(bnd:\#)}\}$.

Based on the high level prosodic parameters in the linguistic description, a target pitch contour and target phoneme durations can also be predicted. Techniques for low level prosodic prediction have been well studied in earlier speech synthesis systems based on prosodic modification of diphones from a small database. Among the methods used are classification and regression trees (CART), neural networks, linear superposition models, and sums of products models. In unit selection the predicted pitch and durations can be included in the properties of the target units.

The speech generation module searches the database of speech units with annotated properties in order to match a sequence of target units with a sequence of database units. The sequence of selected database units is converted to a single speech waveform by a unit concatenation module.

In a trivial case, the sequence of target units can be found directly in the speech database. This happens when the text to be synthesised is identical to the text of one of the recorded sentences in the database. The unit selection module then retrieves the recorded sentence unit per unit. The unit concatenation module joins the waveform units again to reproduce the sentence.

In a non-trivial case, the target units correspond to an unseen text, i.e. a text for which there is no integral recording in the database. To convert an unseen text into a spoken message, the unit selector searches for database units that approximate the target units. Depending on the unit properties that are taken into consideration, the database may not contain a perfect match for each target unit. The unit selector then uses a cost function to estimate the suitability of unit candidates with more or less similar properties as the target unit. The cost function expresses mismatches between unit properties in mathematical quantities, which can be combined into a total mismatch cost. Each candidate unit therefore has a corresponding target cost. The lower the target cost, the more suitable a candidate unit is to represent the target unit.

After the unit selector has identified suitable candidates for a target unit, a join cost or concatenation cost is applied to find the unit sequence that will form a smooth utterance. For example, the concatenation cost is high if the pitch of two units to be concatenated is very different, since this would result in a "glitch" when joining these units. Like the target cost, the concatenation cost can be based on a variety of unit properties, such as information about the phonetic context and high and low level prosodic parameters.

The interaction between the target costs and the concatenation costs is shown in FIG. 2. For each target unit, there is a set of candidate units with corresponding target costs. The target costs are illustrated for the units in the first two columns in FIG. 2 by a number inside the square representing the unit. Between each pair of units in adjacent columns there is a concatenation cost, illustrated for two unit pairs in FIG. 2 using a connecting arrow and a number above the arrow. Because of the concatenation costs, the optimal units are not just the units with the lowest target costs. The optimal unit sequence minimises the sum of target costs and concatenation costs, as shown by the full arrows in FIG. 2. The optimal path can be found efficiently using a dynamic search algorithm, for example the commonly used Viterbi algorithm.

The result of the unit selection step is a single sequence of selected units. After this final sequence of units has been selected, a concatenator is used to join the waveform units of the sequence of selected units into a smooth utterance. Some TTS systems employ "raw" concatenation, where the waveform units are simply played directly after each other. However this introduces sudden changes in the signal which are perceived by listeners as clicks or glitches. Therefore the waveform units can be concatenated more smoothly by looking for an optimal concatenation point, or applying cross-fading or spectral smoothing.

The basic unit selection framework is described in Sagisaka Y., "Speech synthesis by rule using an optimal selection of non-uniform synthesis units," ICASSP-88 New York vol. 1 pp. 679-682, IEEE, April 1988; Hunt A. J. and Black A. W., "Unit selection in a concatenative speech synthesis system using a large speech database", ICASSP-96, pp. 373-376, 1996; and others. Refinements of the unit selection framework have been described among others in U.S. Pat. No. 6,665,641 B1 (Coorman et al), WO02/097794 A1 (Taylor et al), WO2004/070701 A2 (Phillips et al), and U.S. Pat. No. 5,913,193 (Huang et al).

The perceptual quality of messages generated by unit selection depends on a variety of factors. First, the database must be recorded in a noisefree environment and the voice of the speaker must be pleasant. The segmentation of the database into waveform units as well as the annotated unit properties must be accurate. Second, the linguistic analysis of an input text must be correct and must produce a meaningful linguistic description and set of target units. Third, the target and concatenation cost functions must be perceptually relevant, so that the optimal path is not only the best result in a quantitative way (i.e. the lowest sum of target and concatenation costs) but also in a qualitative way (i.e. subjectively the most preferred).

An essential difficulty in speech synthesis is the underspecification of information in the input text compared to the information in the output waveform. Speakers can vary their voice in a multitude of ways, while still pronouncing the same text. Consider the sentence "Bears like honey". In a story about bears, the narrator may emphasise the word "honey", since this word contains more new information than the word bears. In a story about honey, on the other hand, it may be more appropriate to emphasise the word "bears". Even when the emphasis is fixed on one word, for example "honey", there are still many ways to say the sentence. For example, a speaker could lower her pitch and use a whispering voice to say "honey", indicating suspense and anticipation. Or the speaker could raise her pitch and increase loudness to indicate excitement.

The fact that spoken words contain more information than written words poses challenges for unit selection based TTS systems. A first challenge is that voice quality and speaking style changes are hard to detect automatically, so that unit databases are rarely annotated with them. Consequently, unit selection can produce spoken messages with inflections or nuances that are not optimal for a certain application or context. A second challenge is that it is difficult to predict the desired voice quality or speaking style from a text input, so that a unit selection system would not know which inflection to prefer, even if the unit database were appropriately annotated. A third challenge is that the annotation of voice quality and speaking style in the database increases sparseness in the space of available units. The more unit properties are annotated, the less likely it becomes that a unit with a given combination of properties can actually be found in a database of a given size.

Research in unit selection continually aims to improve the default or baseline quality of TTS output. At the same time, there is a need to improve specific utterances (prompts) for a current system. This can be achieved through manual interaction with the unit selection process. Existing techniques to improve unit selection output can be divided in three categories. First, a human operator can interact with the speech database, in order to improve the segmentation and annotation of unit properties. Second, the operator can change the linguistic description of an input text, in order to improve the accuracy of the target units. Third, the operator can edit the target and concatenation cost functions. These techniques are now discussed in more detail.

Improving the Unit Database

The unit database provides the source material for unit selection. The quality of TTS output is highly dependent on the quality of the unit database. If listeners dislike the timbre or the speaking style of the recording artist, the TTS output can hardly overcome this. The recordings then need to be segmented into units. A start time point and end time point for each unit must be obtained. As unit databases can contain several hours of recorded speech, corresponding to thousands of sentences, alignment of phonemes with recorded speech is usually obtained using speech recognition software. While the quality of automatic alignments can be high, misalignments frequently occur in practice, for example if a word was not well-articulated or if the speech recognition software is biased for certain phonemes. Misalignments result in disturbing artefacts during speech synthesis since units are selected that contain different sounds than predicted by their phoneme label.

After segmentation, the units must be annotated with high level prosodic properties such as lexical stress, position of the unit in the syllable structure, distance from the beginning or end of the sentence, etc. Low level prosodic properties such as F0, duration, or average energy in the unit can also be included. The accuracy of the high level properties depends on the linguistic analysis of the recorded sentences. Even if the sentences are read from text (as opposed to recordings of spontaneous speech), the linguistic analysis may not match the spoken form, for example when the speaker introduces extra pauses where no comma was written, speaks in a more excited or more monotonous way, etc. The accuracy of the low level prosodic properties on the other hand depends on the accuracy of the unit segmentation and the F0 estimation algorithm (pitch tracker).

Since the amount of database units is very large, the time needed to check all segmentations and annotations by hand may be prohibitive. A human operator however can modify the segmentation or unit properties for a small set of units in order to improve the unit selection result for a given speech prompt.

Improving the Target Units

TTS systems rely on linguistic resources such as dictionaries and rules to predict the linguistic description of an input text. Mistakes can be made if a word is unknown. The pronunciation then has to be guessed from the orthography, which is quite difficult for a language such as English, and less difficult for other languages such as Spanish or Dutch. Not only the pronunciation has to be predicted correctly, but also the intonation markers and phrase structure of the sentence. Take the example of a simple navigation sentence "Turn right onto the A1". To be meaningful to a driver, the sentence might be spoken like this: "Turn <short break> <emphasis> right <break> onto the <short break> <emphasis> A <emphasis> 1". On the other hand, if the driver already knew that she was looking for the A1, no emphasis may be needed on the road name, but only on the direction of the turn: "Turn <short break> <emphasis> right <break> onto the A1".

It is clear that linguistic rules will not always be successful at predicting the optimal linguistic description of an input text. Controllability of TTS can be improved by enabling operators to edit the linguistic description prior to unit selection. Users can correct the phonetic transcription of a word, or specify a new transcription. Users can also add tags or markers to indicate emphasis and phrase structure. Specification of phonetic transcriptions and high level prosodic markers can be done using a standardized TTS markup language, such as the Speech Synthesis Markup Language (SSML) [http://www.w3.org/TR/speech-synthesis/].

Low level prosodic properties can be manually edited as well. For example operators can specify target values for F0, duration, and energy US2003/0229494 A1 (Rutten et al).

Improving the Unit Selection Cost Functions

In the unit selection framework, candidate units are compared to the target units using a target cost function. The target cost function associates a cost to mismatches between the annotated properties of a target unit and the properties of the candidates. To calculate the target cost, property mismatches must be quantified. For symbolic unit properties, such as the phoneme identity of the unit, different quantisation approaches can be used. A simple quantification scheme is binary, i.e. the property mismatch is 0 when there is no mismatch and 1 otherwise. More sophisticated approaches use a distance table, which allows a bigger penalty for certain kinds of mismatches than for others.

For numeric unit properties, such as the F0 or the duration of a unit, mismatch can be expressed using a variety of mathematical functions. A simple distance measure is the absolute difference $|A-B|$ between the property values of the target and candidate unit. More sophisticated measures apply a mathematical transformation of the absolute difference. The log( ) transformation emphasises small differences and attenuates large differences, while the exponential transformation does the opposite. The difference (A−B) can also be mapped using a function with a flat bottom and steep slopes, which ignores small differences up to a certain threshold U.S. Pat. No. 6,665,641 B1 (Coorman et al).

The quantified property mismatches or subcosts are combined into a total cost. The target cost may be defined as a weighted sum of the subcosts, where the weights describe the contribution of each type of mismatch to the total cost. Assuming that all subcosts have more or less the same range, the weights reflect the relative importance of certain mismatches compared to others. It is also possible to combine the subcosts in a non-linear way, for example if there is a known interaction between certain types of mismatch.

Like the target cost, the concatenation cost is based on a combination of property mismatches. The concatenation cost focuses on the aspects of units that allow for smooth concatenation, while the target cost expresses the suitability of individual candidate units to represent a given target unit.

An operator can modify the unit selection cost functions to improve the TTS output for a given prompt. For example, the operator can put a higher weight on smoothness and reduce the weight for target mismatch. Alternatively, the operator can increase the weight for a specific target property, such as the weight for a high level emphasis marker or a low level target F0.

US2003/0229494 A1 (Rutten et al) describes solutions to improve unit selection by modifying unit selection cost functions and low level prosodic target properties. The operator can remove phonetic units from the stream of automatically selected phonetic units. The one or more removed phonetic units are precluded from reselection. The operator can also edit parameters of a target cost function such as a pitch or duration function. However, modification of these aspects requires expertise about the unit selection process and is time consuming. One reason why the improvement is time consuming is the iterative step of human interaction and automatic processing. When deciding to remove or prune certain units or to adjust the cost function, operators must repeat the cycle including the steps of:

- generating a single speech waveform by a unit selection process with cost optimisation,
- listening to the single speech waveform,
- if the operator is not satisfied,
  - modifying (rejecting) units, modifying target low-level prosodic properties, or
  - modifying costs and starting a new automatic generating step,
- if the operator is satisfied,
  - keeping the actual speech waveform.

After each modifying step a single speech waveform has to be generated by searching in the unit database all possible units matching the target units and by doing all cost calculations. The new speech waveform can be very similar to a speech waveform created before. To find a pleasant waveform an expert may try out several modifications, each modification requiring a full unit selection process.

A more efficient solution should enable an unskilled operator to create very good prompts with minimal evaluation and modification effort.

SUMMARY

At least one embodiment of the present invention describes a unit selection system that generates a plurality of unit sequences, corresponding to different acoustic realisations of a linguistic description of an input text. The different realisations can be useful by themselves, for example in the case of a dialog system where a sentence is repeated, but exact playback would sound unnatural. Alternatively, the different realisations allow a human operator to choose the realisation that is optimal for a given application. The procedure for designing an optimal speech prompt is significantly simplified. It includes the following steps:

- deriving at least one target unit sequence corresponding to the input linguistic description,
- selecting from a waveform unit database a plurality of alternative unit sequences approximating the at least one target unit sequence,
- concatenating the alternative unit sequences to alternative speech waveforms, and presenting the alternative speech waveforms to an operating person and enabling the choice of one of the presented alternative speech waveforms.

The present invention includes a computer program comprising program code means for performing these steps when said program is run on a computer.

There are several advantages to creating a speech prompt according to at least one embodiment of the inventive solution. First, there are no iterative cycles of manual modification and automatic selection, which enables a faster way of working. Second, the operator does not need detailed knowledge of units, targets, and costs, but simply chooses between a set of given alternatives. The fine-tuning of TTS prompts therefore becomes accessible to non-experts. Third, the operator knows the range of achievable realisations and makes an optimal choice, whereas in the iterative approach a better solution may always be expected at a later iteration.

The unit selection system in at least one embodiment of the current invention requires a strategy to generate realisations that contain at least one satisfying solution, but not more realisations than the operator is willing to evaluate. Many alternative unit sequences can be created by making small changes in the target units or cost functions, or by taking the n-best paths in the unit selection search (see FIG. 2). It is known to those skilled in the art that n-best unit sequences typically are very similar to each other, and may differ from each other only with respect to a few units. It may even be the case that the n-best unit sequences are not audibly different, and are therefore uninteresting to an operator who wants to optimise a prompt. Therefore the system will preferably use an intelligent construction algorithm to generate the alternative unit sequences.

DETAILED DESCRIPTION OF EXAMPLE EMBODIMENTS

Figure 3:
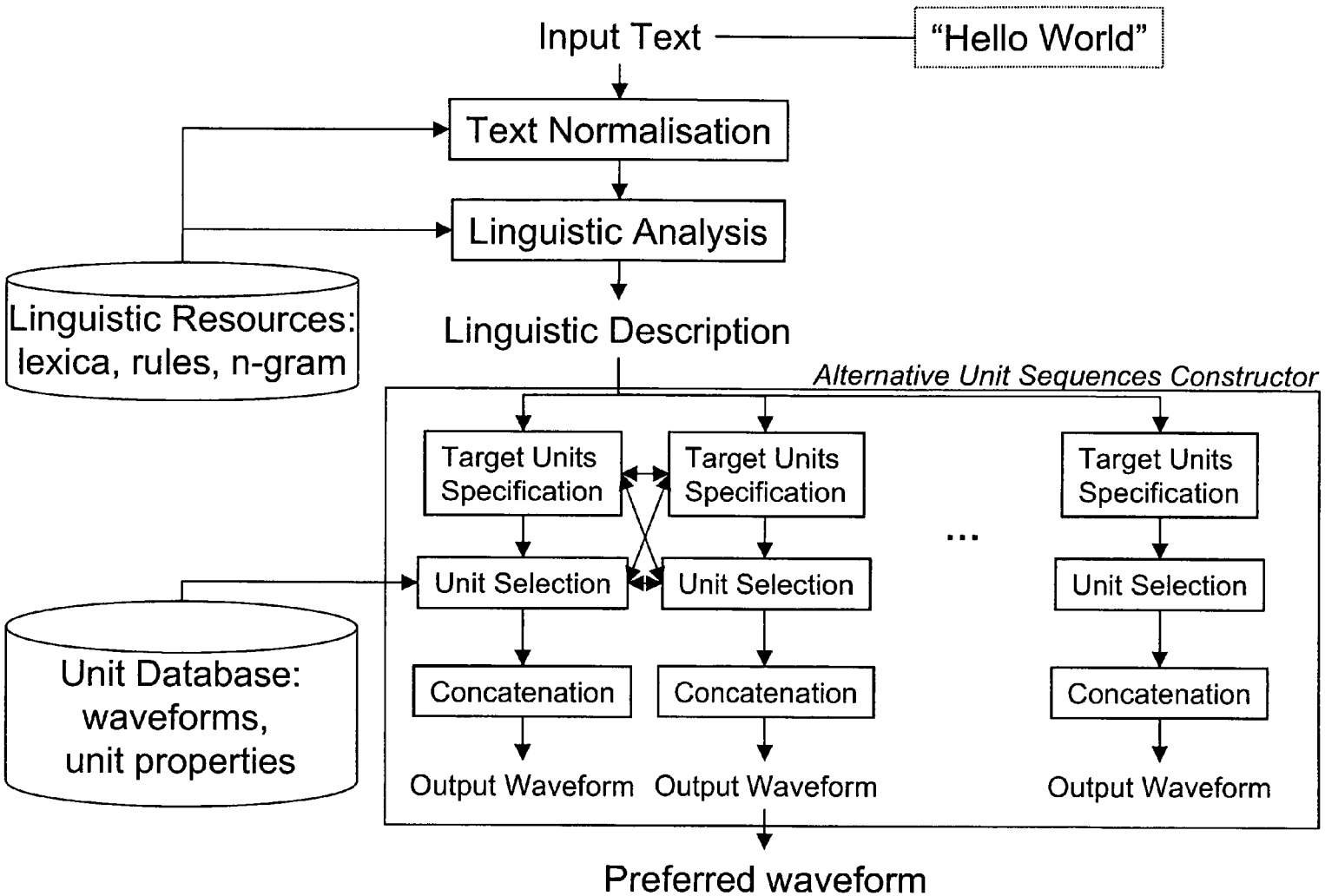
FIG. 3 is a block-diagram view of a unit selection generating alternative unit sequences

FIG. 3 shows an embodiment with an alternative unit sequences constructor module. The constructor module explores the space of suitable unit sequences in a predetermined way, by deriving a plurality of target unit sequences and/or by varying the unit selection cost functions. The alternative output waveforms created by the constructor module result from different runs through the steps of target unit specification, unit selection and concatenation. Any run can be used as feedback to modify target units or cost functions to create alternative output waveforms. This feedback is indicated by arrows interconnecting the steps of target unit specification and unit selection for different unit selection runs.

Figure 4:
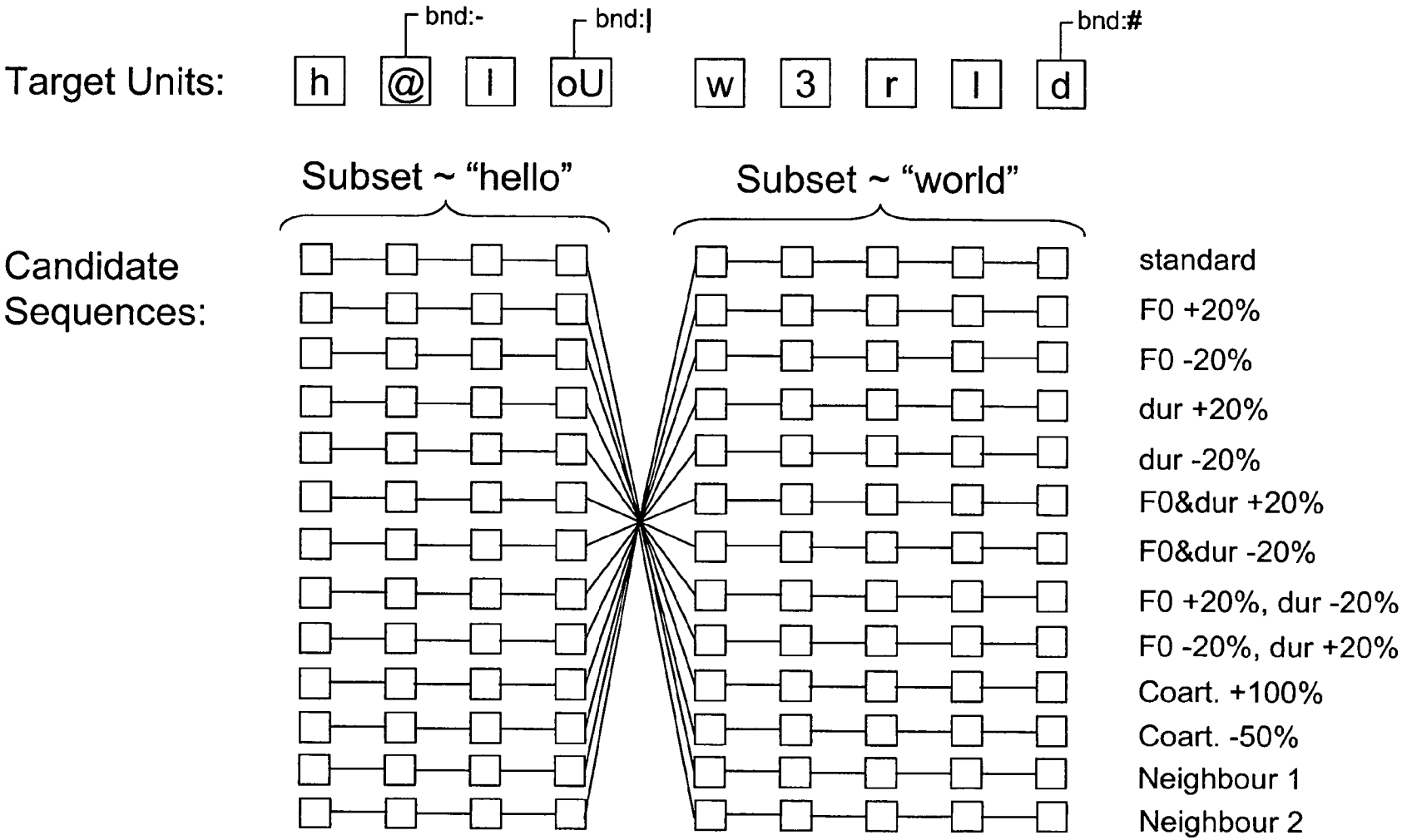
FIG. 4 is a diagram visualising the construction of alternative unit sequences

FIG. 4 explains the construction in more detail for the example text "hello world". The alternative unit sequences are generated separately for each word. The first alternative unit sequence—named "standard"—corresponds to the default behaviour of the TTS system. The second alternative sequence contains units selected with a target pitch that is 20% higher than in the standard unit sequence. The third alternative sequence contains units selected with a target pitch that is 20% lower than in the standard unit sequence. Further alternatives explore duration variations and combinations of F0 and duration variations. The set of 8 alternatives with varying pitch and duration correspond to "expressive" speech variations. The operator can choose a variation that is more excited (higher F0) or more monotonous (lower F0), slower (increased duration), faster (decreased duration), or a combination thereof.

As illustrated in FIG. 4, to get a minimal variation within the set of alternative unit sequences one can define minimal variations for features such as duration or pitch. Examples of variation criteria follow. At least one unit of at least one target unit sequence shall have a target pitch that is higher or lower by a predetermined minimal amount, preferably at least 10%, than the pitch of the corresponding unit of a previously selected unit sequence. At least one unit of at least one target unit sequence shall have a target duration longer or shorter by a predetermined minimal amount, preferably at least 10%, than the duration of the corresponding unit of a previously selected unit sequence. The pitch and duration variations can be chosen according to the needs of a particular application. The difference would be chosen higher, for example at 20% or 40% if distinctly different alternative unit sequences are expected. The difference can be defined as a percentage or as an absolute amount, using a predetermined minimum value or a predetermined range.

Another type of feature variations between unit selection runs modifies the unit selection cost functions. For example, the cost function elements that control pitch smoothness or phonetic context match can be varied. In FIG. 4, the $9^{th}$ and $10^{th}$ alternative are generated respectively with a higher and a lower weight for the phonetic context match (i.e. higher and lower coarticulation strength). For the 9th alternative the phonetic context weight is doubled (Coart. +100%), while for the $10^{th}$ alternative the phonetic context weight is halved (Coart. −50%).

Figure 1:
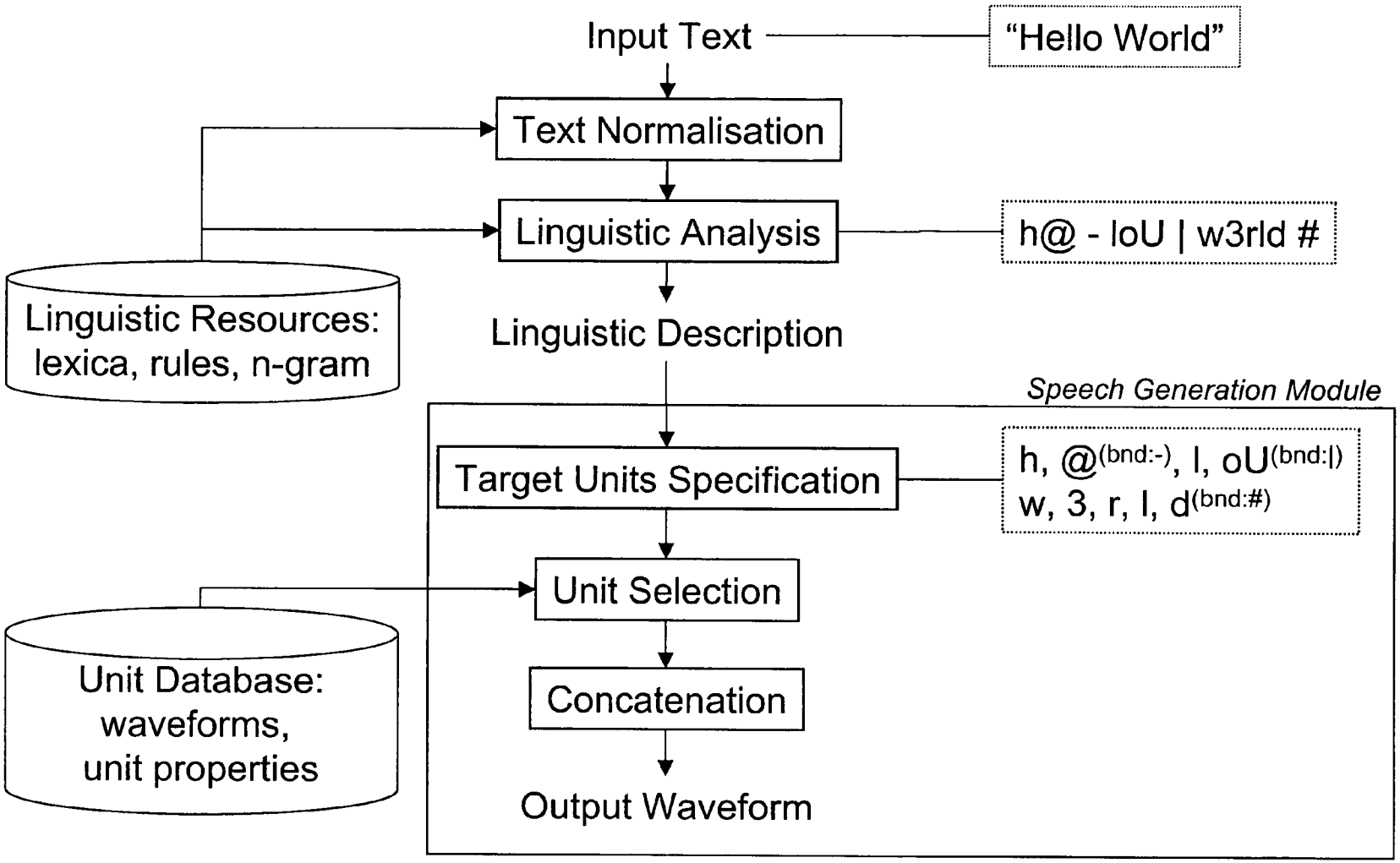
FIG. 1 is a block-diagram view of a general unit selection framework (state of the art)
Figure 2:
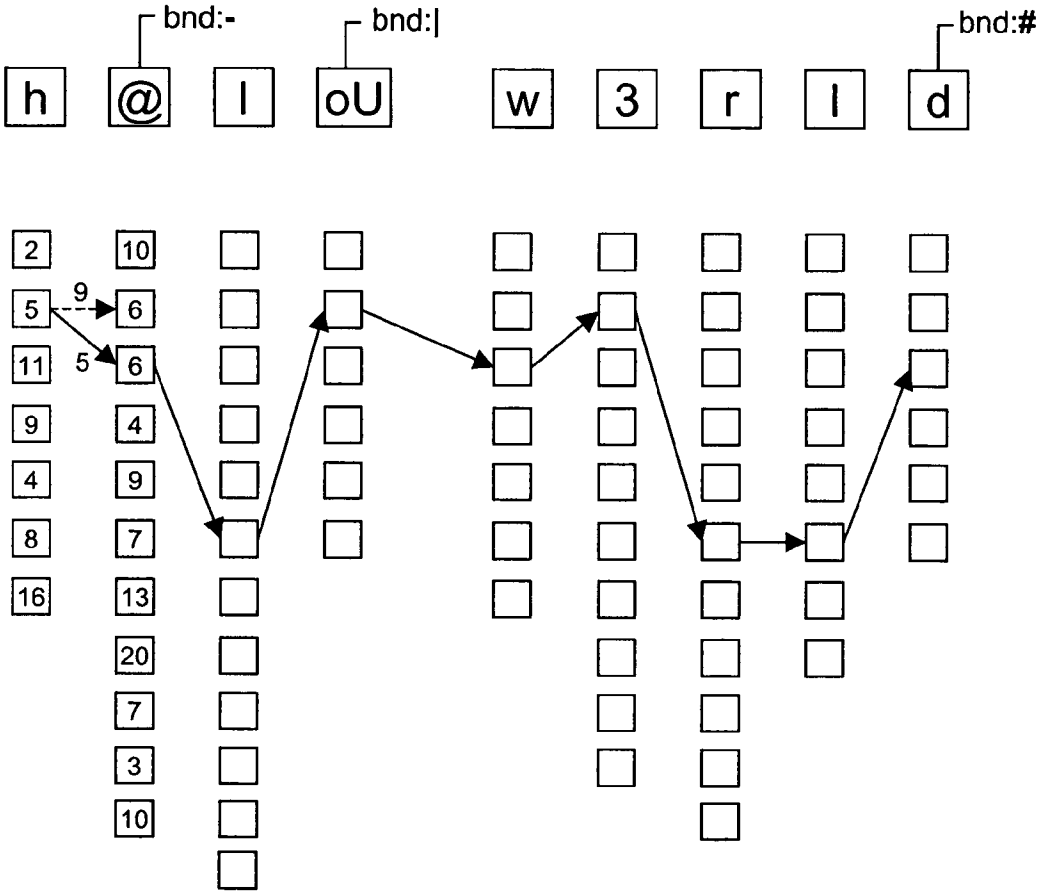
FIG. 2 is a diagram with a cost calculation visualisation

Another type of feature variations triggers the selection of alternative unit sequences with similar F0 and durations as the standard sequence but using adjacent or neighbour units in the search network of FIG. 2. This type of feature variations is motivated by the fact that speech units can differ with respect to voice quality parameters (e.g. hoarseness, breathiness, glottalisation) or recording conditions (e.g. noise, reverberation, lip smacking). Database units typically are not labelled with respect to voice quality and recording conditions, because their automatic detection and parameterisation is more complex than the extraction of F0, duration, and energy. To enable an operator to select a waveform with different voice quality or with a different recording artefact, adjacent or neighbour units are chosen.

Another type of feature variations imposes a minimum spectral distance between a unit in the current unit selection run and a corresponding unit of a previously selected unit sequence. The spectral distance can be defined in the following standard way. First, the candidate unit and the reference unit are parametrised using Mel Frequency Cepstral Coefficients (MFCC) or other features. Duration differences are normalised by Dynamic Time Warping (DTW) or linear time normalisation of the units. Finally, the spectral distance is defined as the mean Euclidean distance between time normalised MFCC vectors of the candidate and reference unit. Other distance metrics such as the Mahanalobis distance or the Kullback-Leibler distance can also be used.

The inventive solution can be refined by partitioning the alternative unit sequences into several subsets. Each subset is associated with a single syllable, word, or other meaningful linguistic entity of the prompt to be optimised. In FIG. 4 the subsets correspond to the two words "hello" and "world". The unit sequences in one subset differ only inside the linguistic entity that characterises the subset. One subset contains alternative unit sequences of the word "hello" and the other subset contains alternative unit sequences of the word "world". The operator can inspect the output waveforms corresponding to alternative unit sequences within each subset, and choose the best alternative. This refinement decouples optimisation of one part of a prompt from optimisation of another part. It does not mean a return to the iterative scheme, as the optimisation of each part still requires exactly one choice and not an iterative cycle of modification and evaluation. There is however a step-wise treatment of the different parts of a prompt.

A further refinement is to use a default choice for several subsets (i.e. syllables or words) of the text to be converted to a speech waveform. The operator needs only to make a choice for those parts of the text where she prefers a realisation that is different from the default. Alternatively, a cache can be built to store the operator's choice for a subset in a given context. If a new prompt needs to be optimised that is similar to another, already optimized prompt, the operator does not need to optimize the subset if a cached choice is available.

The optimisation of subsets can be facilitated with a graphical editor. The graphical editor can display the linguistic entities associated with each subset and at least one set of alternative unit sequences for at least one subset. The editor can also display the entire linguistic description of the prompt to be optimized and provide a means to modify or correct the linguistic description prior to generation of the alternative unit sequences.

Figure 5:
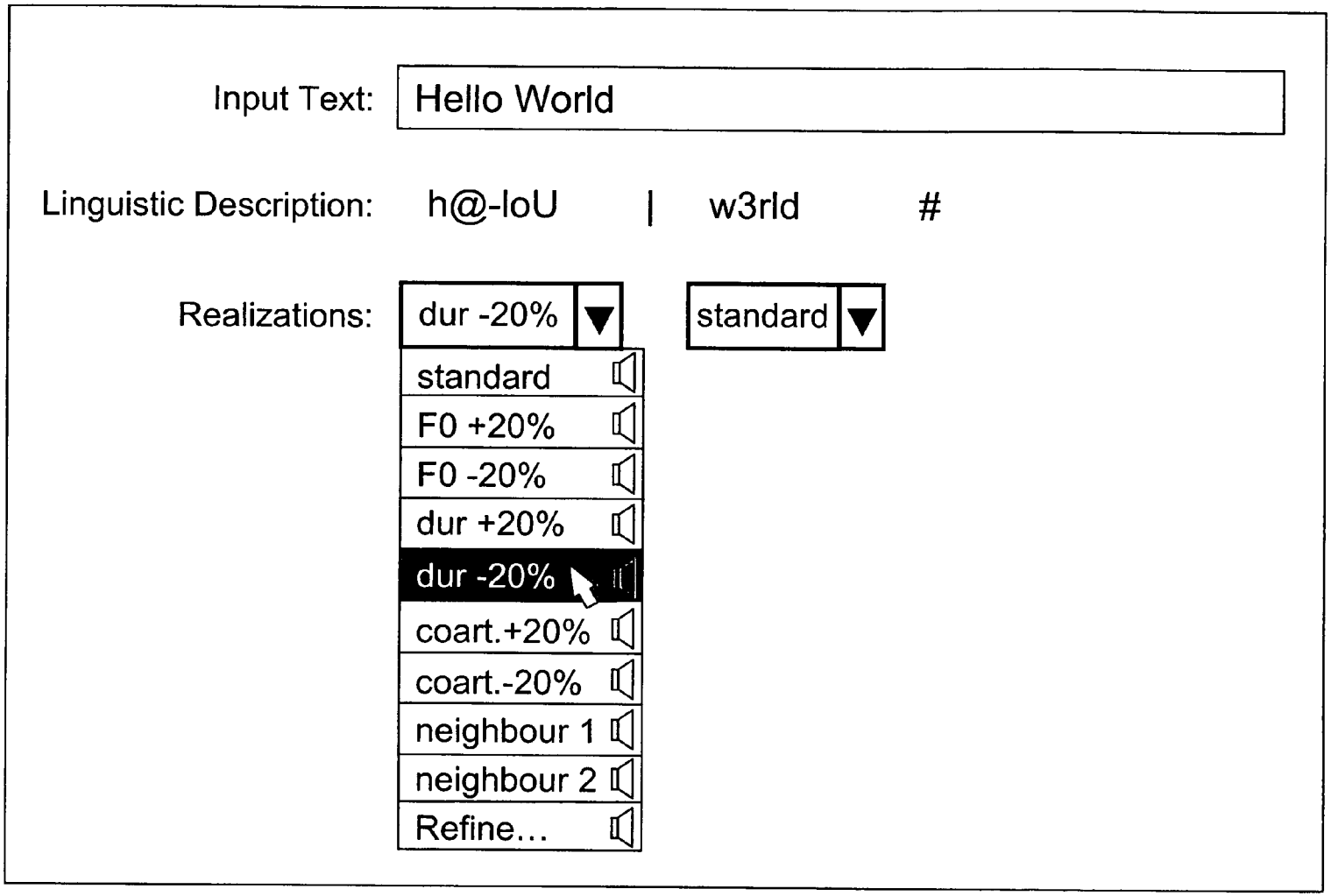
FIG. 5 shows a graphical editor that can be used by an operator to choose an optimal unit sequence

FIG. 5 shows an example of a graphical editor displaying the alternative unit sequences. Each alternative is referenced by a descriptor. By moving the computer mouse over a descriptor the operator can listen to the output waveform corresponding to the alternative referenced by the descriptor. The operator does not need to listen to all alternatives, but she can access only those descriptors that she expects to be most promising. The best sounding alternative is chosen by clicking on it. This alternative will then be indicated as the preferred alternative. The graphical editor initially displays the descriptor corresponding to the currently preferred alternative. If the realisation with the current unit sequence is not sufficient the operator can click on the triangle next to the active descriptor in order to display the alternative unit sequences.

A refinement of the invention, as illustrated in FIG. 5, is to provide the operator with descriptors referencing the alternative unit sequences in a subset. The descriptors enable the operator to evaluate only those alternatives where an improvement can be expected. The realisations in a subset can also be partitioned into further subcategories. For example, realisations in a subset associated with a word can be grouped into a first set of realisations that modify the first syllable in the word, a second set that modify the second syllable, etc. The grouping can be repeated for each subcategory, for example a syllable can be further split into an onset, nucleus, and coda. It will be clear to those skilled in the art that many useful subcategorisations can be made, by decomposing linguistic entities into smaller meaningful entities. This partitioning allows the operator to evaluate alternative unit sequences with variations exactly there, where the prompt shall be improved.

A further refinement of the invention is to present the alternatives to the operator in a progressive way. A first set of alternatives may contain, for example, 20 variants. If the operator does not find a satisfying result in this set, she can request a refined or enlarged set of alternatives. With reference to the alternative unit sequence constructor in FIG. 3, the unit selection cost imposing a difference between the alternatives may be changed, such that a finer sampling of the space of possible realisations is produced.

After optimisation of a speech prompt, the result can be stored as a waveform and used for playback on a device of choice. Alternatively, the operator's choices can be stored in the form of unit sequence information, so that the prompt can be re-created at a later time. The advantage of this approach is that the storage of unit sequence information requires less memory than the storage of waveforms. The optimisation of speech waveforms can be done on a first system and the storing of unit sequence information as well as the re-creation of speech waveforms on a second system, preferably an in-car navigation system. This is interesting for devices with memory constraints, such as in-car navigation systems. Such systems may be provided with a TTS system, possibly a version of a TTS system that is adapted to the memory requirements of the device. Then, it is possible to re-create optimized speech prompts using the TTS system, with minimal additional storage requirements.

Another refinement of the invention is to use the unit sequences corresponding to waveforms selected by the operator as optimal, to improve the general quality of the unit selection system. This can be achieved for example by finding which variations of the target units or cost functions are preferred on average, and updating the parameters of the standard unit selection accordingly. Another possibility is to collect a large set of manually optimized prompts (i.e. 1000 prompts). Then the unit selection parameters (weights) can be optimized so that the default unit selection result overlaps with the manually optimized unit sequences. Preferably a grid search or a genetic algorithm will be used to adapt the unit selection parameters, to avoid local maxima when optimizing the overlap with the set of manually optimized sequences.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for converting an input linguistic description into a speech waveform comprising:

deriving at least one target unit sequence corresponding to the input linguistic description;

assigning in a waveform unit database one or more waveform units to each target unit of the at least one target unit sequence;

selecting for the at least one target unit sequence a plurality of alternative waveform unit sequences approximating the at least one target unit sequence, using the one or more waveform units assigned to each target unit of the at least one target unit sequence;

concatenating the alternative waveform unit sequences to form alternative speech waveforms; and presenting the alternative speech waveforms to an operating person and enabling the choice of one of the presented alternative speech waveforms.

2. Method as in claim 1, wherein said plurality of alternative waveform unit sequences is generated in a predetermined way, by deriving at least one further target unit sequence using feedback from a previously selected waveform unit sequence.

3. Method as claimed in claim 1, wherein at least one unit of at least one target unit sequence has a target pitch that is higher or lower by a predetermined minimal amount than the pitch of the corresponding unit of a previously selected waveform unit sequence.

4. Method as claimed in claim 1, wherein at least one unit of at least one target unit sequence has a target duration that is longer or shorter by a predetermined minimal amount than the duration of the corresponding unit of a previously selected waveform unit sequence.

5. Method as claimed in claim 1, wherein at least one unit of at least one target unit sequence imposes a predetermined difference in a voice quality or recording parameter or in other features, for example the unit identity, compared to a corresponding unit of at least one previously selected waveform unit sequence.

6. Method as claimed in claim 1, wherein at least one unit of at least one target unit sequence imposes a predetermined minimum distance to a corresponding unit of at least one previously selected waveform unit sequence, measured by using an objective distance metric based on a speech parameterization.

7. Method as claimed in claim 1, wherein alternative unit sequences are generated by varying at least one parameter of the unit selection cost functions by a predetermined minimal amount, wherein the at least one varied parameter is preferably the pitch mismatch weight or the phonetic context mismatch weight.

8. Method as claimed in claim 1, wherein the linguistic description is partitioned into at least two subsets for which alternative waveform unit sequences are created and presented to the operator.

9. Method as claimed in claim 8, wherein for at least one subset a predefined default choice of a waveform unit sequence is used instead of choosing a waveform unit sequence by the operating person, wherein said default choice is preferably predefined in a cache storing the operator's choice for a subset in a given context.

10. Method as claimed in claim 8, wherein at least one subset is further partitioned into subcategories for which alternative waveform unit sequences are generated and presented to the operator.

11. Method as claimed in claim 8, wherein the optimisation of subsets is done with a graphical editor, which can display the linguistic entities associated with subsets and at least one set of alternative waveform unit sequences for at least one subset, wherein the alternative waveform unit sequences are referenced by descriptors, allowing the operator to evaluate only those alternatives where an improvement is expected.

12. Method as claimed in claim 1, wherein an operator's choice is stored in the form of unit sequence information, so that the speech waveform can be re-created at a later time, wherein the optimisation of speech waveforms is done on a first system and the storing of unit sequence information as well as the re-creation of speech waveforms is done on a second system, preferably an in-car navigation system.

13. Method as claimed in claim 1, wherein the waveform unit sequences corresponding to waveforms chosen by the operator are used to improve the behaviour of the standard unit selection by updating the system parameters according to the target units or cost function variations preferred on average.

14. Method as claimed in claim 1, wherein the waveform unit sequences corresponding to waveforms chosen by the operator are used to improve the behaviour of the standard waveform unit selection by adapting the unit selection parameters to increase overlap between the default unit sequences and a large set of manually optimized unit sequences.

15. Method as claimed in claim 1, wherein the selecting includes selecting alternative waveform unit sequences with at least one minimal variation criteria.

16. A non-transitory computer readable medium comprising program code for performing all the steps of claim 1 when said program is run on a computer.

17. A text to speech processor for converting an input linguistic description into a speech waveform, said processor comprising:

a deriving unit for deriving at least one target unit sequence corresponding to the input linguistic description;

an assigning unit for assigning in a waveform unit database one or more waveform units to each target unit of the at least one target unit sequence;

a selection unit for selecting the at least one target unit sequence a plurality of alternative unit sequences approximating the at least one target unit sequence, using the one or more waveform units assigned to each target unit of the at least one target unit sequence;

a concatenating unit for concatenating the alternative waveform unit sequences to form alternative speech waveforms; and a presenting unit for presenting the alternative speech waveforms to an operating person and enabling the choice of one of the presented alternative speech waveforms.

18. The processor as claimed in claim 17, wherein the selecting unit is for selecting alternative waveform unit sequences with at least one minimal variation criteria.

* * * * *